US005999141A

United States Patent [19]

Weldon

[11] Patent Number: 5,999,141

[45] Date of Patent: Dec. 7, 1999

[54] ENCLOSED DIPOLE ANTENNA AND FEEDER SYSTEM

[76] Inventor: Thomas Paul Weldon, 9026 Roseton La., Charlotte, N.C. 28277

[21] Appl. No.: 08/867,512

[22] Filed: Jun. 2, 1997

[51] Int. Cl.[6] ..... H01Q 9/26

[52] U.S. Cl. ..... 343/803; 343/817; 343/821; 343/703; 343/872

[58] Field of Search ..... 343/795, 703, 343/797, 749, 803, 821, 815, 817, 819, 865, 878, 834, 872

[56] References Cited

U.S. PATENT DOCUMENTS

| | | | |
|---|---|---|---|
| 4,097,868 | 6/1978 | Borowick | 343/795 |
| 4,496,953 | 1/1985 | Spinks | 343/792 |
| 5,061,944 | 10/1991 | Powers | 343/795 |
| 5,068,672 | 11/1991 | Onnigian | 343/859 |
| 5,168,279 | 12/1992 | Knight | 343/703 |
| 5,202,696 | 4/1993 | Sheriff | 343/741 |
| 5,300,940 | 4/1994 | Simmons | 343/749 |
| 5,387,919 | 2/1995 | Lam | 343/703 |
| 5,463,405 | 10/1995 | Liu et al. | 343/715 |
| 5,657,030 | 8/1997 | Peck et al. | 343/733 |

FOREIGN PATENT DOCUMENTS 137643 of 1947 Australia .

*Primary Examiner*—Don Wong
*Assistant Examiner*—Tho Phan

[57] ABSTRACT

A directional antenna for telecomunication base station applications for home or business is provided. A folded dipole, a passive reflector, a balun and selectively routed coaxial transmission line all enclosed in a plastic enclosure provide improved stability of operating parameters when subjected to significant installation variations. The use of a PVC or similar plastic enclosure results in increased bandwidth while permitting printed circuit techniques and similar electronic construction methods the necessary protection and structural integrity.

4 Claims, 4 Drawing Sheets

Composite view, preferred embodiment.

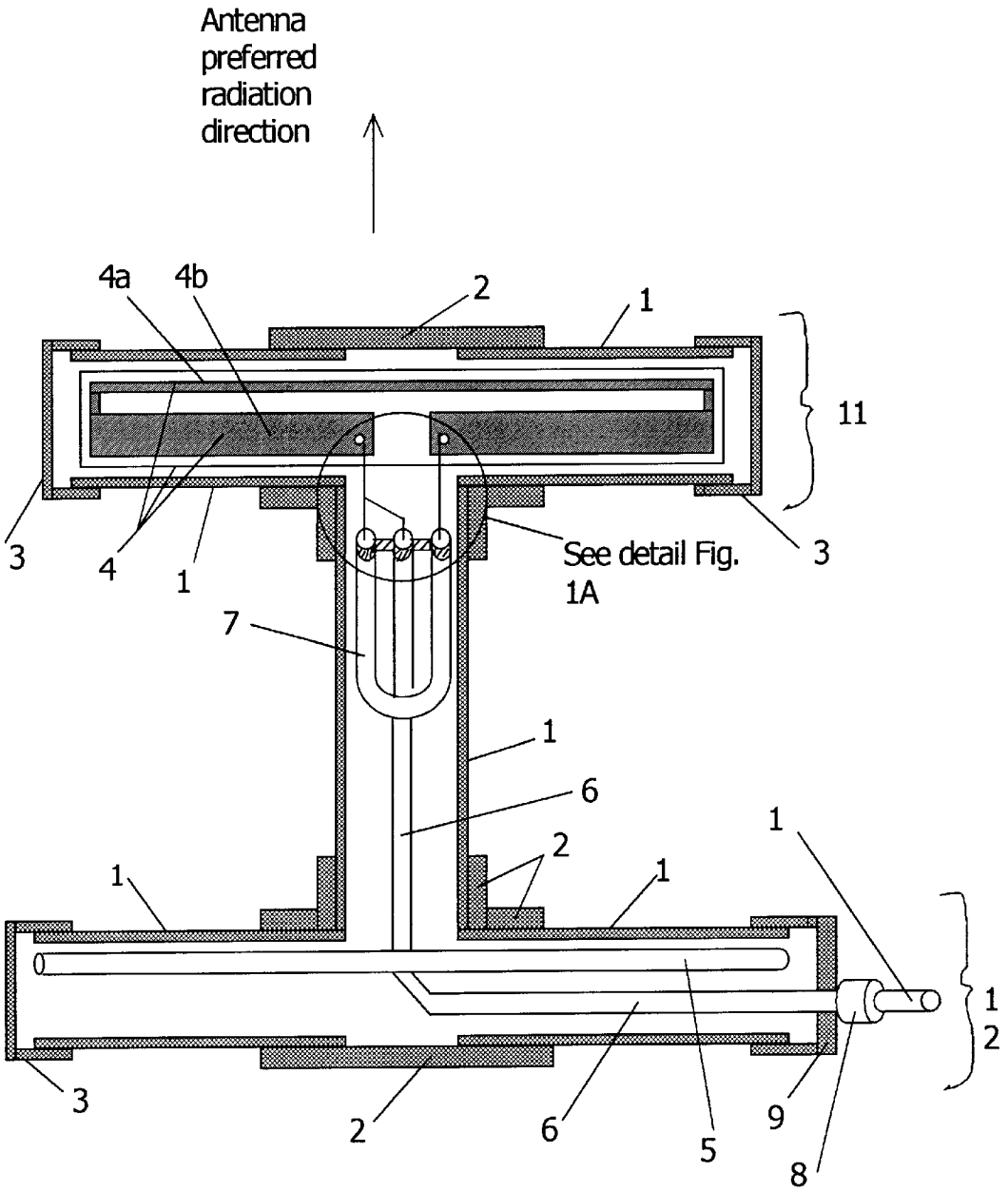
Figure 1 Composite view, preferred embodiment.

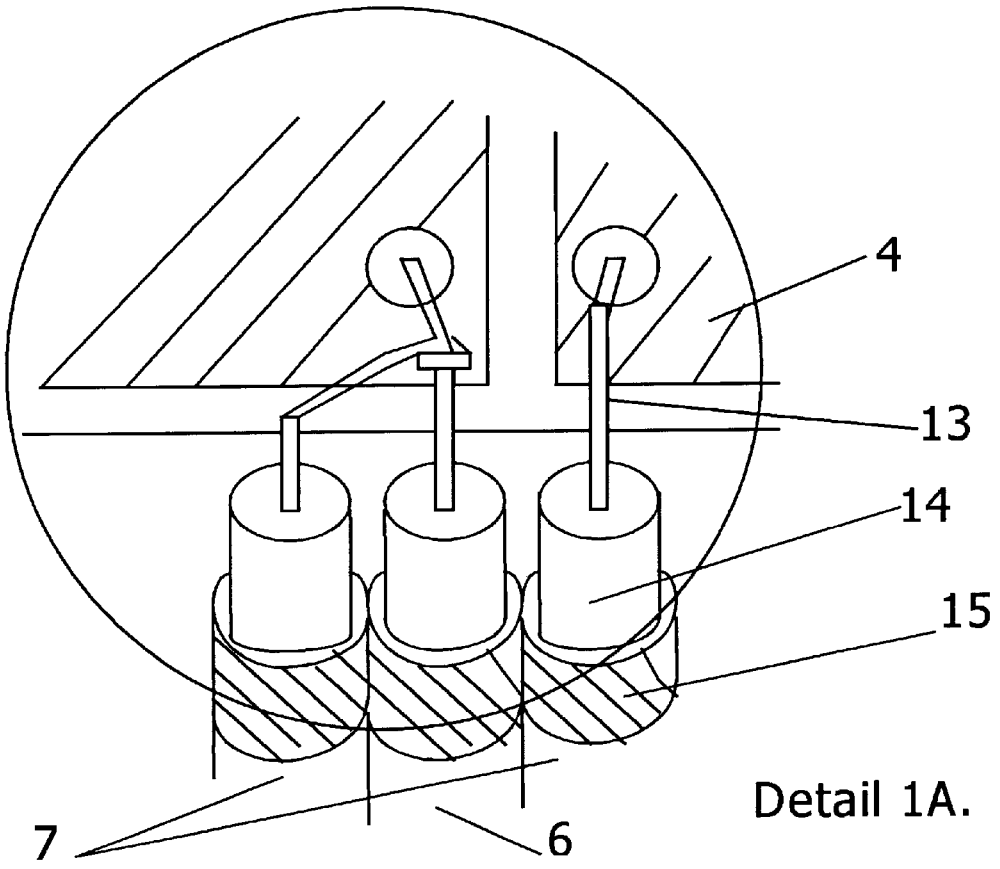
Figure 1A. Detail.

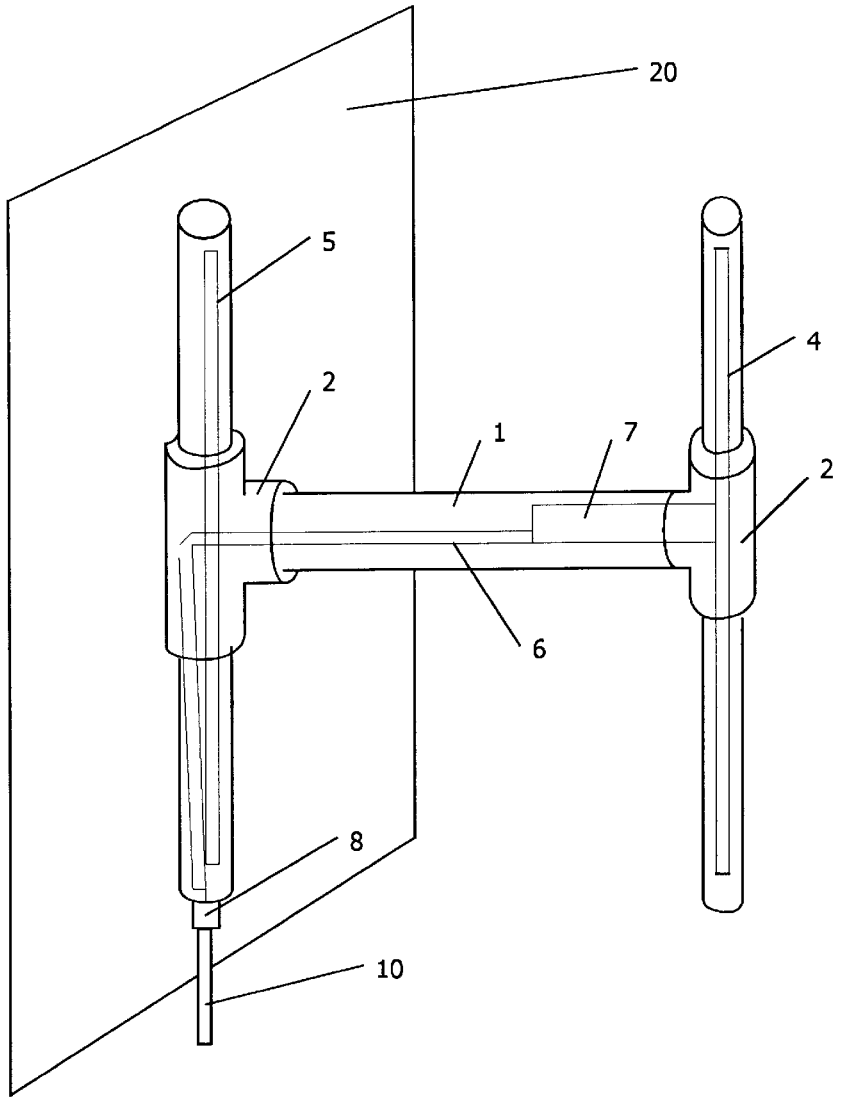
Figure 2. Typical installation.

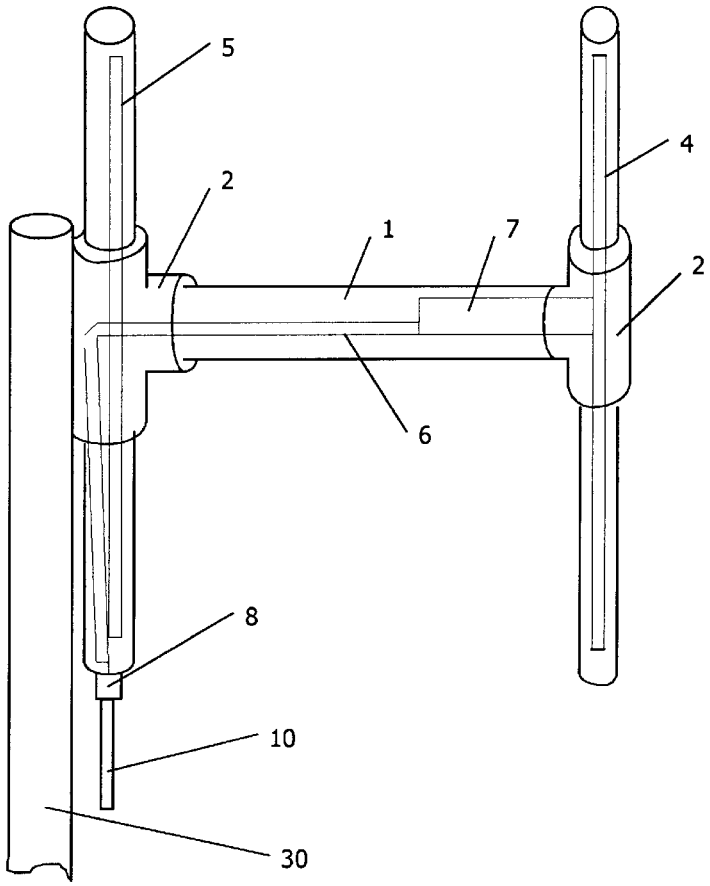
Figure 3.Typical pole-mounted installation.

ENCLOSED DIPOLE ANTENNA AND FEEDER SYSTEM

FIELD OF THE INVENTION

This invention provides an improved antenna assembly for application to radio telecommunications systems in the VHF through UHF range of frequencies, in select bands between 30 and 3000 megahertz. It is an object of the invention to maintain high quality of impedance, bandwidth, radiation pattern, and reception under limiting installation conditions either indoor or out. An application of the invention is anticipated to be in two-way radio communication systems for home and business typically employing distributed repeater stations in large networks.

It is an object of the invention to be broadband and with directivity, consistant with flexibility of installation above, when matched to convential coaxial cable connections to remote transmitter and/or receiving equipment. It is a further objective of this invention that persons of limited skill and knowledge in the art may install complete systems operating at a multitude of assigned frequencies within antenna bandwidth coverage without unacceptable effects on operating efficiencies, including standing wave effects, antenna pattern effects and impedance effects. It is an object of the invention to be cost effective employing plastic housing and printed circuit elements. It is an object of the invention to provide a moderately directive antenna pattern that reduces radiated interference to nearby similar systems.

DESCRIPTION OF PRIOR ART

Dipole and folded dipole antennas are commonly used in the frequency ranges in which this invention will be applied. One common usage is television reception, usually in multi-element assemblies including well known Yagi configuration. Most of these are constructed of tubular conductors, usually aluminum, with steel supporting poles and cross members. The active dipoles are designed to use matching balanced 300 ohm transmission lines to the receiver location. Receiving antennas are broadband, and usually two or more folded dipole active elements dimension-tuned to different frequencies are required to cover the television VHF and UHF frequency bands. An impedance mismatch with associated performance compromise is accepted in receivers as the receiver is the load with the antenna extracting energy from the passing wave. Transmitters on the other hand, can have power output stages destroyed, or range of transmission severely limited, by antenna/line impedance missmatch at operating frequencies.

Means for matching antennas to transmission lines and transmitters include addition of tapered feed lines, fixed and variable reactances and transformers of various types. Many of these are described in textbooks referencing the art as well as the American Radio Relay League's "Radio Amateure's Handbook". Some of these methods require measurements and tuning adjustments of each installation. For instance, some antennas are narrowband and require skilled personnel to trim the length of the radiating antenna elements to tune the impedance to an acceptable level. In other systems transmitters include variable capacitor antenna trimming adjustments to maintain effecient operation. It is a purpose of the present invention to avoid the need for the latter complications for the user.

Folded dipole antennas are widely used for transmit/receive applications as they afford generaly broadband characteristic. In application with transmitters, the folded dipole is designed and fabricated to have a matching impedance to the connecting transmission line. As these antenna's are balanced, a balanced transmission line may be used. A problem arises as these balanced transmission lines can become radiators when employed with transmitters, leading to degraded antenna patterns and transmitting ineffeciencies.

Another common antenna type usually found in fixed and mobile applications is the "whip" antenna. When these are used for transceiver applications they are fitted with reactances, usually inductors, at the base or mid plane to effect matching to coaxial cables and/or adjust for compensating the antennas tuning owing to required shortening for fitting to vehicles. For base stations where large dimensions can be accomodated, a single ½ wave mast with a ground plane provides a simple unbalanced match to a coaxial line.

Two vertical polarized omnidirectional antennas are described in U.S. Pat. Nos. 4,496,953 and 5,387919. These are both center fed by means of coaxial cable routed upward through the lower half section of the dipole with added reactive elements to effect impedance matching. Matching in this case is more complex owing to currents induced in the feedline section routed within the radiating lower half of the dipole.

Another transceiver antenna application becoming more common is in domestic and international cellular radio systems. While the bandwidth within any one cellular system may be relatively small, broadband antennas are desirable since they are less susceptible to becoming detuned by variations in installations and offer advantages in inventory control and quantity pricing for the wide variations in frequencies found in international applications.

Current state of the art is to employ omnidirectional antennae in cellular radio applications at subscriber sites except in remote areas where the long distances to base stations dictate a need for high gain antennae to overcome path losses. As a result of this use of omnidirectional antennae, interfering energy limits effectiveness of nearby subscribers, degrading overall system performance. The present invention helps to alleviate this problem by virtue of directing more energy in the desired direction while reducing energy in other directions. Further, the moderate increase in gain aids in providing increased range of transmission.

SUMMARY OF THE INVENTION

The invention in its basic form is comprised of a two element antenna assembly with provision for coupling to remote transceiver equipment with standard coaxial cable. The antenna assembly includes a half-wave folded dipole element, a balun impedance transforming provision, and a half-wave reflector element similar to established art except that these are totally enclosed in plastic pipe which serves as the weather resistant supporting structure. This enclosure material also increases the capacitance of the assembly which further increases antenna bandwidth. The ratio of inductance to capacitance, a measure of tuning abruptness, is significantly increased over prior art. The invented antenna incorporates impedance matching a quarterwave coaxial cable section routed with connecting cable in a manner such as to have negligible effects on transmit/receive electromagnetic fields. The plastic enclosing pipe also functions as a dielectric shield which makes the antenna arrangement less sensitive to nearby or surrounding materials or structures. This effect is primarily the result of enclosing the active dipole element within a a dielectric boundary of significant radial dimension relative to the dipole proper. The invented antennas performance is substantially maintained when mounting in proximity to building walls, roofs, poles and/or towers serving as supporting structures. A vertical polarization is the preffered antenna installation, however the same benefits are realized when operating in the horizontal polarization mode as well.

The active element is a ½ wave folded dipole designed such that when fitted inside a plastic pipe, it will have an impedance aproximating 4 times that of the coaxial line connecting it to remote transmit and/or receiving equipment. A balun made of ½ wavelength section of coaxial cable along with the connecting coaxial transmission line are routed perpendiculary from the center of the dipole in plastic pipe. The balun nominally transforms the dipole impedance to match the coaxial cable impedance and provides a balanced feed to the half-wave folded dipole. The feeder coaxial cable and balun coax are routed from the dipole center in a perpendicular section of plastic pipe that extends a distance of one-quarter wave from the half-wave folded dipole to a half-wave reflector element. The perpendicular pipe containing the cable joins the center of a reflector element also housed in plastic pipe, and said reflector is placed a nominal ¼ wavelength behind, paralell to, and in the same plane as the folded dipole. The feedline route is continued through one side of the reflector pipe housing so the reflector element by virtue of its resonant length tends to couple impinging radiated fields thus reducing such coupling to the outer wall of the coaxial feedline. The feedline terminates to an end connector for field cabling to the electronics.

DRAWINGS

FIG. 1 is a cross section view of the preffered embodiement of the invented antenna assembly.

FIG. 1A is a detail of the termination of the balun and coaxial feed line.

FIG. 2 illustrates typical wall mounting of the antenna assembly for fixed station, vertically polarized systems.

FIG. 3 illustrates typical mounting for rooftop, pole or tower applications.

DETAIL DESCRIPTION

The prefered embodiement of the invention is illustrated in FIG. 1. Shown is an antenna assembly including a folded dipole, a passive reflector, a balun, a coaxial feedline and terminating connector all enclosed in plastic pipe in a letter H configuration. The active element is a folded dipole of a length approximately equal to ½ wave length at the center frequency of the band to be covered by a specific application. This active element is depicted as item 11, and is comprised of the half-wave folded dipole item 4 enclosed in schedule 40 PVC or similar plastic pipe, item 1, pipe caps item 3, and tee fitting item 2. The folded dipole in the prefered embodiment is fabricated as a conducting loop on a printed circuit board. The impedance of the dipole when fitted into the pipe enclosure would be nominally four times the cable impedance of 50 or 75 ohms, i.e., 200 or 300 ohms, as required by the coaxial cable and connected electronics system, typically 50 or 75 ohms respectively. The center frequency, impedance and bandwidth of the dipole is controlled by modifying the dimensions of the conductive metalic elements items 4*a* and 4*b* of the half-wave folded dipole item 4 and the dimensions of the plastic pipe item 1.

An alternative method of construction of the active element item 11 above may be required for higher power applications or for structural benefits. In these situations the half-wave folded dipole item 4 would be constructed of wire or tubular conducters with spacers or forming to maintain dimensions for design impedances.

The feed line coaxial cable item 6 and a ½ wave length of coax item 7, is connected to the active folded dipole item 4 per FIG. 1 A. Item 7 serves as an impedance transformer and line balancing per established art in matching the folded dipole impedance to the connecting feedline, item 6. All three of he outer shields of the coaxial cables item 15 are electrically connected, coaxial cable dielectrics item 14 protrude minimally, and center conductors item 13 protrude minimally making electrical connection to each other as shown and connecting to the half-wave folded dipole arms as shown. Items 6 and 7 are housed in a pipe section item 1, with the transmission line continuing into the passive reflector assembly item 12, thence to an RF bulkhead connector item 8 of standard design. Typically the dipole will be designed for 200 ohms for transform to 50 ohm coax used in item 6, 7 and finally the site installed field connections, item 10, to the transceiver.

The passive reflector assembly item 12, consists of a metalic conductor strip (reflector) typically copper or aluminum, item 5, pipe enclosing elements item 1, end cap 3, and tee element 2 enclosing the assembly to the active dipole 11 above. The reflector element item 5 is dimensioned at slightly longer than the folded dipole item 4, tuned slightly below the center frequency, and mounted in the same plane as the active folded dipole element. The interconnecting plastic pipe item 1 encloses the connecting coax 6 and ½ wave balun transformer 7, centered on the active dipole item 11. The field electrical connection to the antenna is accomodated via a standard RF connector item 8, mounted in an adaptor item 9, customized to mount the RF connector and seal the pipe/antenna enclosure. A mating connector and coaxial cable item 10 would be routed to the remote electronics by the field installer. An alternative terminating means for field installation may use a coaxial cable extension "pigtail" as an end user option. For vertical polarizations the connector 10 would be facing downward for field installed cable routing to the transceiver electronics.

Typical design for the active element operable in the UHF range of frequencies centered at f(Mhz), would use ½inch PVC 1120 sch 40 pipe with an overall length of 5000/f inches, a reflector of 1 inch PVC sch 40 and of length 5600/f inches, spaced 2900/f inches from the active dipole. The balun would be 4000/f inch section of rg58 or equivalent 50 ohm coax, item 7 and the same coax would serve for the feedline connection, item 6, to the RF connector, item 8.

For higher power, lower frequency designs or severe weather considerations, the use of tubular or other structural shape of the reflector conductor is anticipated to be necessary to provide added structural integrity in certain applications. Such tubular or wire construction may also offer economic advantages.

The assembled antenna has a directivity pattern indicated by the arrow in FIG. 1. The reflector shields incident radio frequency from the opposite direction, enhancing signal to noise ratio favoring the chosen alignment. This is of significant benefit in applications where multiple communication systems are using the same band. Such directivity also reduces the effect of the antenna installation mounting surface on the electrical characteristics of the antenna. To a large extent walls or poles of FIGS. 2 and 3 as used for subscriber mounting, become a part of the passive reflector.

A number of mounting schemes are envisioned for the new antenna. As the vertical polarization is the prefered mode of operation, FIGS. 2 and 3 illustrate the two most useful means anticipated. FIG. 2 depicts a mounting of the reflector by clamping directly to a wall item 20 or side of a building. Since directivity exists, the active folded dipole element can be aligned with remote targeted systems by rotation about the axis of the included reflector element through almost + or −90 degrees from a perpendicular to the wall. If this method of mounting includes an additional offsetting structure, the wall serves as a second added reflector further, improving directivity.

FIG. 3 illustrates a typical mast or post mounting which provides good possibility as to alignment of direction and a minimal degradation of impedance, bandwidth, and antenna pattern. Such an arrangement may be more costly or not available in many instances.

The basic invention may be extended in range or directivity by addition of additional passive reflector elements after the principles of Yagi by adding directors or additional reflectors. The basic enclosed elements remain as above. A director element would be tuned to a slightly higher frequency than the active dipole, item 4, as opposed to the lower frequency of a parassitic reflector. Each added element would enhance directivity and selectivity and resultant increase in range which could be benificial in remote fringe areas or sparsely populated regions.

The basic invention may be implemented using a director instead of the reflector.

I claim:

1. An antenna for communication systems comprising a folded dipole, a balun, a connecting coaxial transmission line, a reflector member, and dielectric shield means for making said antenna less sensitive to nearby or surrounding structures, wherein said dielectric shield means encloses said folded dipole, said balun, said connecting coaxial transmission line, and said reflector member, with said reflector member having one side facing said folded dipole, said reflector member having an opposite side, with said connecting coaxial transmission line facing, parallel, and adjacent to said opposite side of the reflector member, said connecting coaxial transmission line and said balun further connecting to said folded dipole on the centerline of and perpendicular to radiated fields of said folded dipole so as to minimize induced currents in said balun and said connecting coaxial transmission line which would otherwise adversely affect antenna performance parameters, whereby antenna pattern, antenna impedance, and operating frequency of said antenna are less sensitive to surrounding structures in the location where said antenna is installed.

2. The antenna as defined in claim 1 wherein said dielectric shield means enclosing said folded dipole comprises schedule 40 PVC pipe, wherein said schedule 40 PVC pipe is ½ inch diameter with an overall length of 5000/f inches where f is the operating frequency of the antenna in megahertz.

3. The antenna as defined in claim 1 wherein said dielectric shield means enclosing said reflector member comprises schedule 40 PVC pipe, wherein said schedule 40 PVC pipe is ½ inch diameter with an overall length of 5600/f inches where f is the operating frequency of the antenna in megahertz.

4. The antenna as defined in claim 1 wherein said balun utilizes a ½ wavelength coaxial line routed with said connecting coaxial transmission line.

* * * * *